United States Patent [19]

Hyytinen

[11] 3,945,296

[45] Mar. 23, 1976

[54] GAS PISTON IN A FIREARM

[75] Inventor: Timo Hyytinen, Jyvaskyla, Finland

[73] Assignee: Valmet Oy, Finland

[22] Filed: Mar. 11, 1974

[21] Appl. No.: 450,381

[30] Foreign Application Priority Data

Mar. 12, 1973 Finland ..... 750/73

[52] U.S. Cl. ..... 89/191 A

[51] Int. Cl.[2] ..... F41D 5/10

[58] Field of Search ..... 89/191 A

[56] References Cited

UNITED STATES PATENTS

| | | | |
|---|---|---|---|
| 3,709,092 | 1/1973 | Tazome | 89/191 A |
| 3,810,412 | 5/1974 | Zamacola | 89/191 A |

*Primary Examiner*—Stephen C. Bentley

*Attorney, Agent, or Firm*—Steinberg & Blake

[57] ABSTRACT

A piston such as a gas piston of a firearm. The piston includes a substantially rigid cylindrical body having an end region which fluid-tightly and slidably engages one surface while extending from the latter surface toward but terminating short of a second surface which is fluid-tightly and slidably engaged by an elastic sealing ring of the piston. The end region of the piston member is formed with a groove receiving a flange of the sealing ring and the latter has a wall extending from the flange to define with a lip situated on one side of the groove a gap of a predetermined radial width. Situated in this groove between the lip and the flange of the sealing ring is a snap ring which has between its peripheral edges a radial width greater than the width of the gap for securely maintaining the sealing ring in its operative relationship with respect to the piston member.

3 Claims, 4 Drawing Figures

GAS PISTON IN A FIREARM

BACKGROUND OF THE INVENTION

The present invention relates to pistons.

In particular, the present invention relates to pistons of the type which are used to serve as gas-operated pistons of firearms.

As is well known it is conventional to provide certain types of firearms with gas-operated pistons. Such a piston is displaced by part of the gas resulting from the firing of a projectile, so that the energy resulting from the explosion in the firearm is used to move the gas piston. This movement of the gas piston is utilized in a known way to cock the firearm automatically in preparation for firing the next round. Thus, with such a firearm upon firing of one round part of the gas under pressure is deflected from the barrel to a gas-operated piston which is displaced to cock the firearm and place it in a condition ready for firing the next round.

Pistons of this type are subject to extremely great stresses. Thus in the above example when a round is fired the gas piston is subject to a considerable impact stress, this stress being a variable magnitude as a result of the different magnitudes or strengths of the charges which are fired. A piston of the above general type is required to have a fluid-tight sliding engagement with outer and inner cylindrical surfaces. For manufacturing purposes such a piston has a substantially rigid part fluid-tightly engaging one of these surfaces and an elastic sealing ring which engages the other of these surfaces. Thus, by providing a construction where the piston includes interconnected rigid and elastic components for respectively fluid-tightly and slidably engaging coaxial cylindrical surfaces one of which surrounds the other, it is possible to simplify the manufacture since precise coaxial relationships between the sealing surfaces of the piston need not be maintained and thus maintenance of extremely strict manufacturing tolerances can be avoided. However, while the manufacturing of pistons including a pair of such components provides certain advantages, there are disadvantages in that up to the present time no satisfactory structure has been found to maintain the piston components reliably assembled with each other. Thus, in view of the stresses which are encountered during operation considerable difficulty has been encountered in maintaining the elastic sealing ring properly assembled with the rigid part of the piston. As a result, conventional assemblies cannot withstand the large impact stresses over a long period of time, and the result is that the sealing ring of the piston does not remain properly assembled with the rigid part of the piston so that a desired seal is not maintained and the assembly comes apart in time to such an extent that proper operation cannot be assured and repairs are required.

SUMMARY OF THE INVENTION

It is accordingly a primary object of the present invention to provide a construction which will avoid the above drawbacks.

In particular, it is an object of the present invention to provide a piston with a construction which will enable it to withstand reliably over a long period of time even the substantially large impact stresses of the type which are encountered in connection with firearms.

Moreover, it is an object of the present invention to provide a piston construction of the above type which is made up of components which can be readily assembled without any danger of disassembly occurring due to large impact stresses.

In particular it is an object of the present invention to provide a construction of the above general type which will permit the parts to become disassembled from each other only shearing of relatively strong components such as an end lip of a substantially rigid piston member or a springy metal snap ring.

According to the invention the piston is designed to be used with coaxial inner and outer bodies arranged with the outer body surrounding and spaced from the inner body and having an inner cylindrical surface coaxially surrounding and spaced from an outer cylindrical surface of the inner body to define with the latter surface a cylindrical space of given thickness. The piston includes a substantially rigid cylindrical member which extends at least partly into the latter space and which has in this space an end region fluid-tightly and slidably engaging one of the above surfaces while extending from this one surface toward but terminating short of the other surface so that the thickness of the end region of the piston member is less than the thickness of the space which receives this end region. The end region of the piston member is formed inwardly of an end face thereof with a circular groove directed toward the other of the surfaces and defining with the end face a lip which has a peripheral edge also directed toward this other of the surfaces of the above bodies. A sealing ring fluid-tightly and slidably engages this other surface and has a flange extending into the groove of the end region of the piston member with this sealing ring having a wall extending from its flange toward the lip and defining with the peripheral edge thereof a circular gap of predetermined radial width. Situated in the groove between the lip and the flange of this sealing ring is a snap ring which has inner and outer peripheral edges between which the snap ring has a width which is greater than the predetermined width of the above gap. As a result of this construction it is not possible for the sealing ring to become disassembled from the piston member except by shearing of the snap ring and/or shearing of the piston member.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
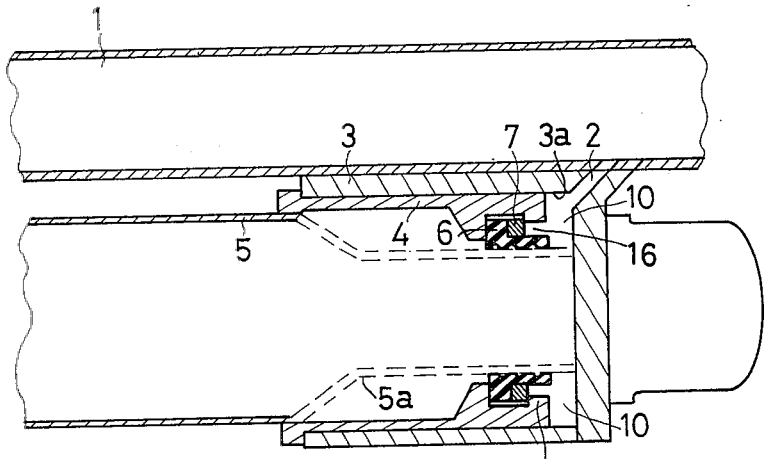
FIG. 1 is a partly schematic longitudinal sectional elevation fragmentarily illustrating part of a firearm which is provided with a piston of the invention which is shown in an axial section in FIG. 1.
Figure 2:
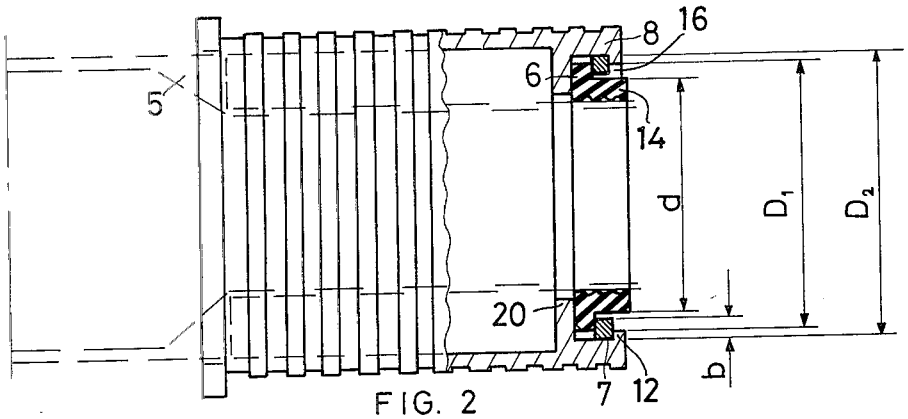
FIG. 2 is a partly sectional illustration of the piston of the invention shown in FIG. 2 in an operating position on a schematically illustrated body tube with FIG. 2 indicating the diameters of various components as well as the radial width thereof.

Referring to FIGS. 1 and 2, there is shown particularly in FIG. 1 a cylindrical body 3 which is fixed, as by brazing, to the barrel 1 of a firearm. The barrel 1 and the body 3 are formed with a common bore 2 providing communication between the interior space 10 of the cylindrical body 3 and the interior of the barrel 1. The body 3 is closed at its right end, as viewed in FIG. 1, by a suitable end wall. Thus, the bore 2 forms a gas passage through which part of the gas under pressure will flow into the body 3 when a round is fired. An elongated body tube 5 extends coaxially into the body 3 and has a fixed relationship with respect thereto. The relationship between bodies 3 and 5 is such that while the outer body 3 is coaxially spaced from and surrounds part of the body 5, the body 3 has an inner cylindrical surface of circular cross section 3*a* which coaxially surrounds and is spaced from an outer surface 5*a* of the body 5, this outer surface 5*a* also being cylindrical and of a circular cross section so that between these surfaces 3*a* and 5*a* the space 10 has an elongated cylindrical configuration.

The piston 4 of the present invention includes a substantially rigid cylindrical member 8 shown in FIG. 2 in somewhat greater detail than in FIG. 1. This piston member 8 extends partly into the space 10. The body 5 has beyond the interior of the body 3 an elongated portion which has a larger diameter than the portion provided with the exterior cylindrical surface 5*a*, and the left end of the piston member 8 slides along the exterior surface of the larger diameter portion of the body 5. This end of the member 8 terminates in an outwardly directed flange engaging the left end of the body 3, as shown in FIG. 1, so that in this way movement of the piston member 8 to the right, as viewed in FIG. 1, is limited, thus assuring that the gas which enters through the bore 2 will engage the right end of the piston 4, as viewed in FIG. 1. At its right end, as viewed in FIGS. 1 and 2, the substantially rigid cylindrical piston member 8 terminates in a circular end face directed toward the right, as viewed in FIGS. 1 and 2, and this end face forms part of an end region of the piston member 8 which extends from the surface 3*a* toward but terminates short of the surface 5*a*, coaxially surrounding the latter and of course being spaced therefrom. This end region of the piston member 8 is formed at its interior with a circular groove 9 which defines with the right end surface of the piston member 8, as viewed in FIGS. 1 and 2, a lip 12 which has an inner peripheral edge directed toward and surrounding the surface 5*a* and being coaxial therewith.

An elastic sealing ring 6, made of any suitable resilient elastic material capable of being compressed and capable of expanding back to its original condition has at its left end, as viewed in the drawings, a flange extending into the groove 9. This flange of the sealing ring 6 engages at its left end surface, as viewed in the drawings, an interior flange of the piston member 8 situated at the left end of the groove 9. The sealing ring 6 includes a wall 14 which fluid-tightly and slidably engages the surface 5*a* and which extends from the flange at the left end region of the sealing ring 6 toward and into the space surrounded by the lip 12. The lip 12 defines with the wall 14 a circular gap 16 which has a predetermined radial width and which coaxially surrounds the wall 14. As may be seen from FIG. 2, the width of the gap 16 is equal to ½ the difference between the diameter $D_1$ of the inner peripheral edge of the lip 12 and the outer diameter d of the wall 14.

Figure 4:
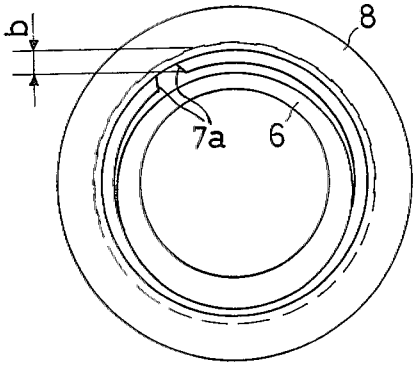
FIG. 4 is an end view of FIG. 3 as seen from the right of FIG. 3 with FIG. 4 also illustrating how the assembly operations go forward.

Situated in the groove 9 between the flange of the sealing ring 6 and the lip 12 is a snap ring 7 which serves to lock the sealing ring 6 in the assembled condition shown in FIGS. 1 and 2 with respect to the piston member 8. Thus, the piston 4 includes the substantially rigid piston member 8, the snap ring 7, and the elastic sealing ring 6. As will be apparent from the description which follows, the relationship between the components is such that it is impossible for the sealing ring 6 to emerge out of the groove 9 unless there is shearing of the snap ring 7 or the lip 12. The snap ring 7 is made of a springy metal and extends almost through a complete circle. As is shown in FIG. 4, the snap ring 7 has a pair of free ends 7*a* located closely adjacent to and directed toward each other and being spaced from each other only by a small distance so that in this way it is possible for the snap ring 7 to spring inwardly or outwardly, this snap ring 7 thus having a construction similar to that of a conventional piston ring. Also, as is shown in FIGS. 2 and 4, between its inner and outer peripheral edges the snap ring 7 has a radial width *b*. The advantages achieved by the present invention result from the fact that this width *b* of the snap ring 7 is greater than the width of the circular gap 16. Thus, the inner diameter of the snap ring 7 is at least equal to the outer diameter *d* of the wall 14, and since the width *b* of the snap ring 7 is greater than the width of the snap 16, the outer circular peripheral portion of the snap ring 7 is necessarily at all times situated behind the lip 12 in overlapping relationship therewith, so that the sealing ring 6 cannot move out of the groove 9 except by shearing of the snap ring 7 and/or the lip 12.

Figure 3:
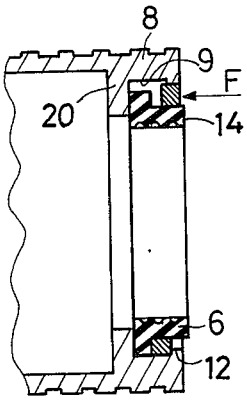
FIG. 3 is a fragmentary sectional elevation of an end region of the piston of the invention, FIG. 3 illustrating operations in connection with the assembly of the components.

FIGS. 3 and 4 illustrate how the components of the piston 4 are assembled. The assembly of the components is carried out before the tube 5 is connected with the body 3 so that after the piston components are assembled the piston 4 is introduced into the body 3 and then the tube 5 is introduced through the piston 4 to be connected with the right end wall of the body 3, as shown schematically in FIG. 1. During the assembly of the components, the sealing ring 6 is first introduced into the groove 9 and is then pressed to one side. Thus, FIG. 3 as well as FIG. 4 illustrate how the sealing ring 6 is displaced downwardly as viewed in FIGS. 3 and 4. The result is that the gap between the outer surface of the wall 14 and the inner peripheral edge of the lip 12 has a minimum width at the side toward which the sealing ring is pressed and a maximum width at the diametrically opposed side, this being the top of the assembly with the position of the parts shown in FIGS. 3 and 4. At this location where the gap 16 has its greatest width, the sealing ring 7 is introduced and pushed inwardly in the direction indicated by the arrow F in FIG. 3. In this way it is possible to push the snap ring 7 through the widest part of the gap into the groove 9 until a part of the ring 7 snaps behind the lip 12. This operation is continued while the ring 7 and the sealing ring 6 are turned through suitable increments, and of course the snap ring 7 can spring inwardly during this operation. Thus after one end of the snap ring 7 has been introduced in this way the snap ring 7 and the ring 6 are turned through successive angular increments while continuing to push the snap ring 7 into the groove 9 until finally the opposite end of the snap ring 7 passes through the gap and the snap ring 7 then springs outwardly to its original unstressed diameter where it will circularly and coaxially surround the axis of the piston member 8 with the ring 6 of course at this time returning also to a position where its axis coincides with the axis of the piston member 8. Of course the inner diameter of the sealing ring 6 has a magnitude which provides the sliding fluid-tight engagement between the inner surface of the sealing ring 6 and the surface 5*a*, so that once all of the parts are assembled as shown in FIG. 1, the surface 5*a* will reliably center the sealing ring 6 with respect to the piston member 8.

As a further feature of the present invention, in order to facilitate the assembly of the components the radial width *b* of the snap ring 7 is slightly smaller than ½ the difference between the diameter $D_2$ of the innermost circular surface of the groove 9 and the outer diameter *d* of the wall 14. As a result of this feature once the first part of the snap ring 7 is displaced through the gap 16 it can snap into the groove 9 to engage the innermost surface thereof and facilitate the introduction of the remainder of the snap ring 7. When the snap ring 7 springs outwardly to its fully assembled condition located in its entirety to the left of the lip 12, as viewed in FIG. 2, the outer peripheral edge of the snap ring 7 can directly engage the innermost surface of the groove 9 with the outer diameter of the ring 7 in its unstressed condition being substantially equal to the diameter $D_2$, so that in this way the maximum area of contact between the snap ring 7 and the lip 12 is achieved while at the same time the fact that the width *b* of the ring is greater than the width of the gap 16 reliably maintains the parts in their assembled condition. Of course the outer diameter of the flange at the left end of the sealing ring 6 as viewed in the drawings, is greater than the inner diameter of the snap ring 7, this outer diameter of the latter flange being approximately equal to the diameter $D_1$ so that in this way the sealing ring 6 can be introduced into the right end portion of the piston member 8 by being easily displaced through the space surrounded by the lip 12. It is to be noted in this connection that the groove 9 is limited on its right side by the lip 12 and on its left side by the inwardly directed flange 20 of the piston member 8. This flange 20 has an inner diameter which is only slightly greater than the diameter of the surface 5*a* and which is smaller than the outer diameter *d* of the wall 14 of the sealing ring 6, so that the groove 9 has a much greater depth at its side limited by flange 20 as compared to the depth of the groove 9 at its side limited by the lip 12. Therefore, the sealing ring 6 is to be considered as received within the interior of the groove 9 even if the flange at the left of the sealing ring 6 has an outer diameter substantially equal to the diameter $D_1$, and in fact it will be seen that the sealing ring 6 has a large area of contact with the flange 20.

Furthermore, it is to be noted that the axial thickness of the flange at the left end of the sealing ring 6, as viewed in the drawings, plus the axial thickness of the snap ring 7 provide a total thickness which is equal to the axial length of the groove 9 between the lip 12 and the flange 20, so that the space between the lip 12 and the flange 20 is completely occupied by the sealing ring flange and the snap ring. As a result of this feature during reciprocation of the piston there will be no relative axial reciprocation between the components 6, 7, and 8 of the piston, and this feature also contributes to the security of the assembly.

What is claimed is:

1. In a firearm, outer and inner coaxial bodies arranged with said outer body surrounding and spaced at least partly from said inner body with said outer body having an inner cylindrical surface of circular cross section surrounding and spaced from an outer cylindrical surface of circular cross section of said inner body so that said surfaces define between themselves a cylindrical space of a given thickness, a piston comprising a substantially rigid cylindrical member extending at least partly into said space and having in the latter space an end region fluid-tightly and slidably engaging one of said surfaces and extending from said one surface toward but terminating short of the other of said surfaces so that said end region has a thickness less than said predetermined thickness, said end region of said member terminating in an end face and being formed inwardly of said end face with a circular groove directed toward said other surface and defining with said end face a lip having a peripheral edge also directed toward said other surface, an elastic sealing ring fluid-tightly and slidably engaging said other surface and having at one end a flange extending into said groove and spaced from said lip, said sealing ring having a cylindrical wall extending from said flange toward said lip and defining with said lip a circular gap of predetermined radial width, and a springy snap ring situated in said groove between said flange and lip, said snap ring having inner and outer peripheral edges one of which is situated in said groove between said lip and flange and the other of which is situated adjacent said wall of said sealing ring, and said snap ring having between said peripheral edges thereof a radial width greater than the predetermined width of said gap, said end region of said member engaging the inner surface of said outer body while said sealing ring engages the outer surface of said inner body so that said end region of said member surrounds said sealing ring and said snap ring.

2. The combination of claim 1 and wherein said member has at the innermost part of said groove a circular surface surrounding said flange of said sealing ring and defining with said wall thereof a second circular gap of a predetermined radial width occupied by said snap ring, the width of the latter between said peripheral edges thereof being smaller than said width of said second gap.

3. The combination of claim 2 a barrel to which said outer body is fixed, and said outer body and barrel being formed with a common bore providing communication between the interior of said outer body and said space between said inner and outer bodies at a part of the latter space which is in communication with said end face of said member.

* * * * *